US010829978B2

(12) United States Patent
Bae et al.

(10) Patent No.: US 10,829,978 B2
(45) Date of Patent: Nov. 10, 2020

(54) SYSTEM AND METHOD FOR OPERATING VEHICLE DOOR

(71) Applicant: FARADAY&FUTURE INC., Gardena, CA (US)

(72) Inventors: Hong S. Bae, Torrance, CA (US); Pei Chen, Torrance, CA (US)

(73) Assignee: FARADAY & FUTURE INC., Gardena, CA (US)

( * ) Notice: Subject to any disclaimer, the term of this patent is extended or adjusted under 35 U.S.C. 154(b) by 64 days.

(21) Appl. No.: 15/365,705

(22) Filed: Nov. 30, 2016

(65) Prior Publication Data

US 2017/0152698 A1 Jun. 1, 2017

Related U.S. Application Data

(60) Provisional application No. 62/261,623, filed on Dec. 1, 2015.

(51) Int. Cl.
*E05F 15/73* (2015.01)

(52) U.S. Cl.
CPC ..... *E05F 15/73* (2015.01); *E05F 2015/763* (2015.01); *E05F 2015/767* (2015.01)

(58) Field of Classification Search
CPC ..... E05F 15/73; E05F 2015/767; E05F 2015/763
See application file for complete search history.

(56) References Cited

U.S. PATENT DOCUMENTS

2015/0025751 A1* 1/2015 Sugiura ..... B60J 5/06 701/49
2015/0284984 A1* 10/2015 Kanter ..... E05F 15/76 49/31
2016/0139579 A1* 5/2016 Hirota ..... H03K 17/9622 700/275
2016/0237733 A1* 8/2016 Henseleit ..... B60J 5/047
2017/0030737 A1* 2/2017 Elie ..... E05F 15/70
2017/0032599 A1* 2/2017 Elie ..... G06F 3/005
2017/0306685 A1* 10/2017 Harding ..... E05F 15/73

OTHER PUBLICATIONS

Machine translation of Chinese Office Action dated May 16, 2018 for application No. 201710063590.6, a counterpart application to U.S. Appl. No. 15/417,330, 8 pages.

* cited by examiner

*Primary Examiner* — Rodney A Butler
(74) *Attorney, Agent, or Firm* — Veros Legal Solutions, LLP

(57) ABSTRACT

A method for opening a vehicle door may include capturing a first image when a first condition is met and capturing a second image when a second condition is met. The first condition is one of the vehicle is parked, or the door is locked. The second condition is one of the vehicle is deactivated, or the door is unlocked. The method may further include detecting an object outside based on the first and second images, determining whether the detected object is within a projected path of the door moving from a first position to a second position, and controlling operation of an actuator configured to move the door, such that if the detected object is determined to be within the projected path of the door, the actuator does not move the door according to the projected path.

20 Claims, 5 Drawing Sheets

SYSTEM AND METHOD FOR OPERATING VEHICLE DOOR

CROSS-REFERENCE TO RELATED APPLICATIONS

This application claims the benefit of U.S. Provisional Application No. 62/261,623, filed on Dec. 1, 2015. The subject matter of the aforementioned application is incorporated herein by reference.

TECHNICAL FIELD

The present disclosure generally relates to systems and methods for operating a vehicle door.

BACKGROUND

A vehicle door is usually equipped with a handle. Such handle is often located below the outer belt line of the door and allows people to manually open the doors. Although this method may be easy to implement, there are some shortcomings. For example, an operator may have to carefully move the door in order to avoid the contact between the door and an object in the vicinity of the vehicle (for example, another vehicle next to the vehicle), which may cause damage to the door and/or the object. Therefore, it may be desirable to detect one or more objects that may be in the path of a door when it is moved to an open position.

SUMMARY

One aspect of the present disclosure is directed to a system for opening a door of a vehicle. The system may include an image sensor configured to capture one or more images, and an actuator configured to move the door from a first position to a second position. The system may also include a controller configured to control the image sensor to capture a first image if a first condition is met, wherein the first condition may be one of: the controller determines that the vehicle is parked, or the controller determines that the door is locked. The controller may also be configured to control the first image sensor to capture a second image if a second condition is met, wherein the second condition may be one of: the controller determines that the vehicle is deactivated, or the controller determines that the door is unlocked. The controller may further be configured to detect an object outside the vehicle based on the first image and the second image, and determine whether the detected object is within a projected path of the door moving from the first position to the second position. The controller may also be configured to control operation of the actuator, such that if the detected object is determined to be within the projected path of the door, the actuator does not move the door according to the projected path, and if no object is detected in the projected path, the actuator moves the door according to the projected path.

Another aspect of the present disclosure is directed to a method for opening a door of a vehicle. The method may include capturing, by an image sensor, a first image when a first condition is met, wherein the first condition may be one of: a controller determines that the vehicle is parked, or the controller determines that the door is locked. The method may also include capturing, by the image sensor, a second image when a second condition is met, wherein the second condition may be one of: the controller determines that the vehicle is deactivated, or the controller determines that the door is unlocked. The method may further include detecting, by the controller, an object outside the vehicle based on the first image and the second image, and determining, by the controller, whether the detected object is within a projected path of the door moving from a first position to a second position. The method may also include controlling, by the controller, operation of an actuator configured to move the door, such that if the detected object is determined to be within the projected path of the door, the actuator does not move the door according to the projected path, and if no object is detected in the projected path, the actuator moves the door according to the projected path.

Yet another aspect of the present disclosure is directed to a non-transitory computer-readable medium storing instructions that, when executed, cause one or more processors to perform a method for opening a door of a vehicle. The method may include receiving a first image captured by an image sensor when a first condition is met, wherein the first condition may be one of that: the vehicle is parked, or the door is locked. The method may also include receiving a second image captured by the image sensor when a second condition is met, wherein the second condition may be one of that: the vehicle is deactivated, or the door is unlocked. The method may further include detecting an object outside the vehicle based on the first image and the second image, and determining whether the detected object is within a projected path of the door moving from a first position to a second position. The method may also include controlling operation of an actuator configured to move the door, such that if the detected object is determined to be within the projected path of the door, the actuator does not move the door according to the projected path, and if no object is detected in the projected path, the actuator moves the door according to the projected path.

DETAILED DESCRIPTION

The disclosure is directed to a system and method for opening and closing a vehicle door. The vehicle, on which the system and method may be implemented, may be an electric vehicle, a fuel cell vehicle, a hybrid vehicle, a conventional internal combustion engine vehicle, or combinations thereof. The vehicle may have any body style, such as a sports car, a coupe, a sedan, a pick-up truck, a station wagon, a sports utility vehicle (SUV), a minivan, or a conversion van. The vehicle may be configured to be operated by an operator, occupying the vehicle, remotely controlled, and/or it may be autonomous.

In some embodiments, the system may be configured to open or close a door of the vehicle in different modes based on an operator's input. For example, the system may operate in a powered mode, in which at least a part of the opening or closing is performed by one or more actuators controlled by a controller. The system may also include a sensor to detect an object that is within a vicinity of a portion of a door. The system may further include a protecting mechanism configured to prevent the door from coming into contact with such object.

Figure 1:
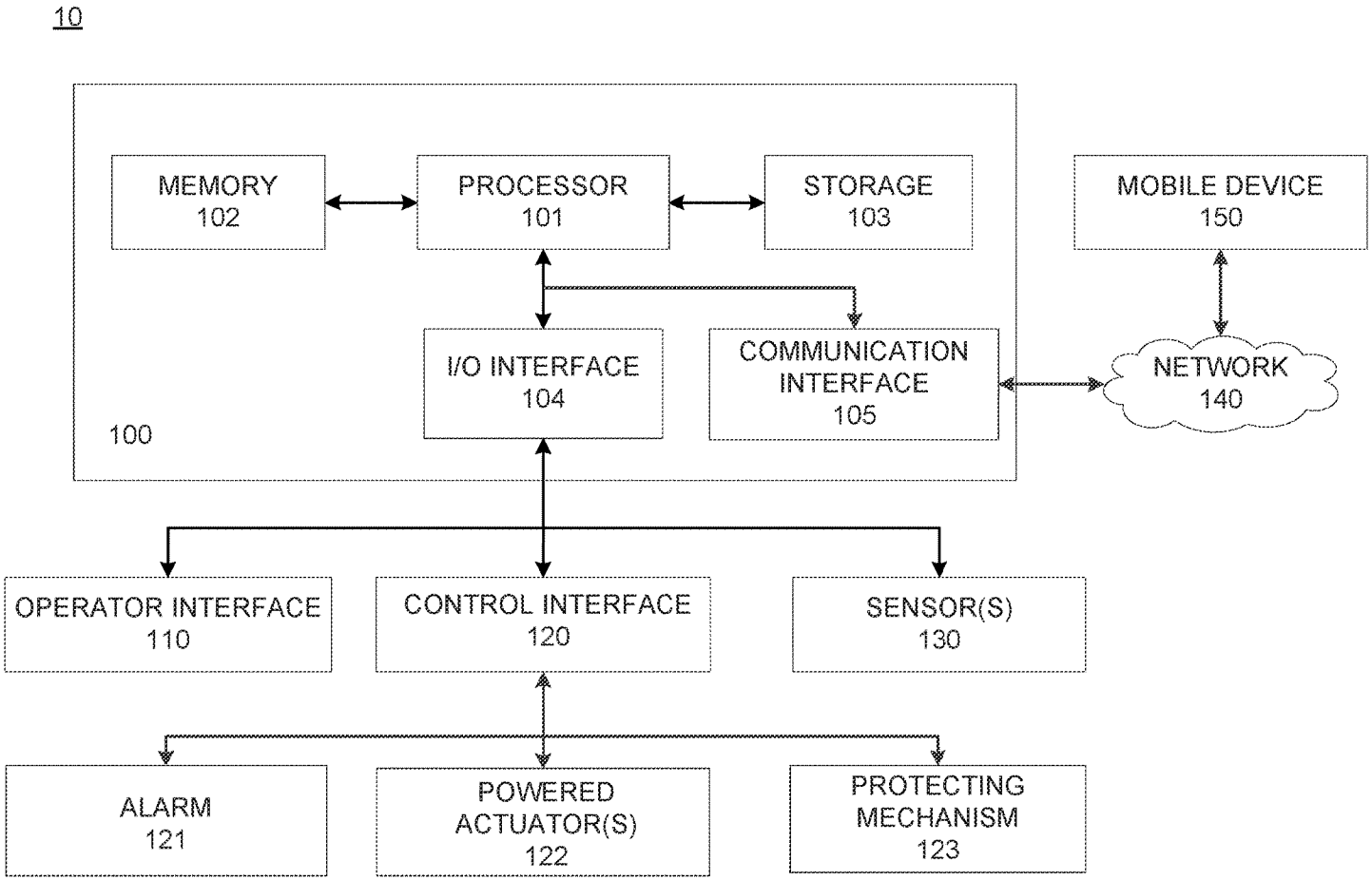
FIG. 1 is a block diagram of an exemplary embodiment of a system for opening a vehicle door.

FIG. 1 shows a block diagram of an exemplary system 10 for opening a door of a vehicle. As illustrated in FIG. 1, system 10 may include a controller 100, an operator interface 110, a control interface 120, and one or more sensors 130. System 10 may also include an alarm 121 configured to generate an audio, visual, or display alert under certain circumstances. System 10 may further include one or more actuators 122 configured to open or close the doors of the vehicle. In some embodiments, actuator(s) 122 may be powered. Actuators 122 may be one of a linear actuator or a motor configured to cause a door to move to a destination position determined by controller 100. For example, actuators 122 may be electrically, hydraulically, and/or pneumatically powered. Other types of actuators are contemplated. In some embodiments, system 10 may also include a protecting mechanism 123 configured to resist movement of the doors under certain circumstances.

Controller 100 may have, among other things, a processor 101, memory 102, storage 103, an I/O interface 104, and/or a communication interface 105. At least some of these components of controller 100 may be configured to transfer data and send or receive instructions between or among each other.

Processor 101 may be configured to receive signals from components of system 10 and process the signals to determine one or more conditions of the operations of system 10. Processor 101 may also be configured to generate and transmit a control signal in order to actuate one or more components of system 10. For example, processor 101 may determine that the vehicle is parked by detecting, for example, that the operator of the vehicle places the transmission in the park position and/or that other systems of the vehicle are in a status that indicates that the vehicle is parked. Processor 101 may also generate a first control signal. Processor 101 may further transmit the first control signal to an image sensor (e.g., a camera) and control the image sensor to capture a first image. Processor 101 may also determine whether the operator subsequently deactivates the vehicle, which may indicate that the operator may open the door at the driver side and leave the vehicle. Processor 101 may then generate a second control signal, which may then be transmitted to the image sensor for capturing a second image. Processor 101 may further analyze the first and second images, and detect, based on the analysis of the images, one or more objects outside the vehicle that may be within a projected path of the door as it opens. If one or more objects are detected to be within the projected path, processor 101 may generate a third control signal to control interface 120, which may then control actuator(s) 122 such that the door may not move according to the projected path.

In operation, according to some embodiments, processor 101 may execute computer instructions (program codes) stored in memory 102 and/or storage 103, and may perform exemplary functions in accordance with techniques described in this disclosure. Processor 101 may include or be part of one or more processing devices, such as, for example, a microprocessor. Processor 101 may include any type of a single or multi-core processor, a mobile device, a microcontroller, a central processing unit, a graphics processing unit, etc.

Memory 102 and/or storage 103 may include any appropriate type of storage provided to store any type of information that processor 101 may use for operation. Memory 102 and storage 103 may be a volatile or non-volatile, magnetic, semiconductor, tape, optical, removable, non-removable, or other type of storage device or tangible (i.e., non-transitory) computer-readable medium including, but not limited to, a ROM, a flash memory, a dynamic RAM, and a static RAM. Memory 102 and/or storage 103 may also be viewed as what is more generally referred to as a "computer program product" having executable computer instructions (program codes) as described herein. Memory 102 and/or storage 103 may be configured to store one or more computer programs that may be executed by processor 101 to perform exemplary functions disclosed in this application. Memory 102 and/or storage 103 may be further configured to store data used by processor 101. For example, memory 102 and/or storage 103 may be configured to store parameters for controlling one or more actuators 122, including, for example, the distances that a door may travel during movement and/or the maximum angle through which the door may pivot. Memory 102 and/or storage 103 may also be configured to store the thresholds used by processor 101 in determining processes as described herein. For example, memory 102 and/or storage 103 may store a threshold distance used by processor 101 to determine whether an object is too close to the door as explained herein.

I/O interface 104 may be configured to facilitate the communication between controller 100 and other components of system 10. I/O interface 104 may also receive signals from one or more sensors 130, and send the signals to processor 101 for further processing. I/O interface 104 may also receive one or more control signals from processor 101, and send the signals to control interface 120, which may be configured to control the operations of one or more sensors 130, one or more actuators 122, protecting mechanism 123, and/or alarm 121.

Communication interface 105 may be configured to transmit and receive data with, among other devices, one or more mobile devices 150 over a network 140. For example, communication interface 105 may be configured to receive from mobile device 150 a signal indicative of unlocking a door. Communication interface 105 may also transmit the signal to processor 101 for further processing.

Operator interface 110 may be configured to generate a signal for locking, unlocking, opening, or closing the door in response to an action by an operator (e.g., a driver, a passenger, or an authorized person who can access the vehicle or open or close the vehicle door). Exemplary action by the operator may include a touch input, gesture input (e.g., hand waving, etc.), a key stroke, force, sound, speech, face recognition, finger print, hand print, or the like, or a combination thereof. In some embodiments, operator interface 110 may also be configured to activate or deactivate the vehicle in response to the operator's action. Operator interface 110 may also generate a signal based on the operator's action, and transmit the signal to controller 100 for further processing.

Operator interface 110 may be located on the interior side of the door and/or other component(s) inside the vehicle. Operator interface 110 may be part of or located on the exterior of the vehicle, such as, for example, an outer belt, an A-pillar, a B-pillar, a C-pillar, and/or a tailgate. Additionally or alternatively, operator interface 110 may be located on the interior side of the door and/or other component(s) inside the vehicle. For example, operator interface 110 may be part of or located on the steering wheel, the control console, and/or the interior side of the door (not shown). In some embodiments, operator interface 110 may be located on or within parts connecting the door and the locking mechanism of the vehicle. Operator interface 110 may sense a force pushing the door exerted by the operator inside or outside the vehicle, and generate a signal based on the force. For example, operator interface 110 may be a pull handle, a button, a touch pad, a key pad, an imaging sensor, a sound sensor (e.g., microphone), a force sensor, a motion sensor, or a finger/palm scanner, or the like, or a combination thereof. Operator interface 110 may be configured to receive an input from the operator. Exemplary input may include a touch input, gesture input (e.g., hand waving, etc.), a key stroke, force, sound, speech, face recognition, finger print, hand print, or the like, or a combination thereof. Operator interface 110 may also generate a signal based on the received input and transmit the signal to controller 100 for further processing.

Control interface 120 may be configured to receive a control signal from controller 100 for controlling, among other devices, sensor(s) 130, alarm 121, actuator(s) 122, and/or protecting mechanism 123. Control interface 120 may also be configured to control sensor(s) 130, alarm 121, actuator(s) 122, and/or protecting mechanism 123 based on the control signal.

Sensor 130 may be located on the exterior of the door or vehicle, the interior side of the door, or inside the vehicle. Sensor 130 may include one or more image sensors (e.g., image sensor 132 and image sensor 134 illustrated in FIG. 3) configured to capture one or more images. Sensor 130 may also include one or more distance sensors (e.g., distance sensor 136 illustrated in FIG. 3) configured to determine a distance between an object outside the vehicle and at least a portion of the vehicle. In some embodiments, distance sensor 136 may include a sensor configured to emit light such as visible, UV, IR, RADAR, LiDAR, and other useful frequencies for irradiating the surface of the surrounding object(s) and measuring the distance of such object(s) from the door based on the reflected light received. In some embodiments, distance sensor 136 may include an ultrasonic sensor configured to emit ultrasonic signals and detect object(s) based on the reflected ultrasonic signals. Other types of sensors for determining the distance between an object and a portion of the vehicle are contemplated.

According to some embodiments, mobile device 150 may be configured to generate a signal indicative of activating or deactivating the vehicle. In some embodiments, mobile device 150 may be configured to generate a signal indicative of locking, unlocking, opening, or closing a door in response to the operator's input. Mobile device 150 may transmit the signal to system 10 over network 140. Network 140 may be any type of wired or wireless network that may allow transmitting and receiving data. For example, network 140 may be wired, a local wireless network, (e.g., Bluetooth™, WiFi, near field communications (NFC), etc.), a cellular network, or the like, or a combination thereof. Other network types are contemplated.

Mobile device 150 may be any type of a general purpose computing device. For example, mobile device 150 may include a smart phone with computing capacity, a tablet, a personal computer, a wearable device (e.g., Google Glass™ or smart watches, and/or affiliated components), or the like, or a combination thereof. In some embodiments, a plurality of mobile devices 150 may be associated with selected persons. For example, mobile devices 150 may be associated with the owner(s) of the vehicle, and/or one or more authorized people (e.g., friends or family members of the owner(s) of the vehicle).

Figure 2:
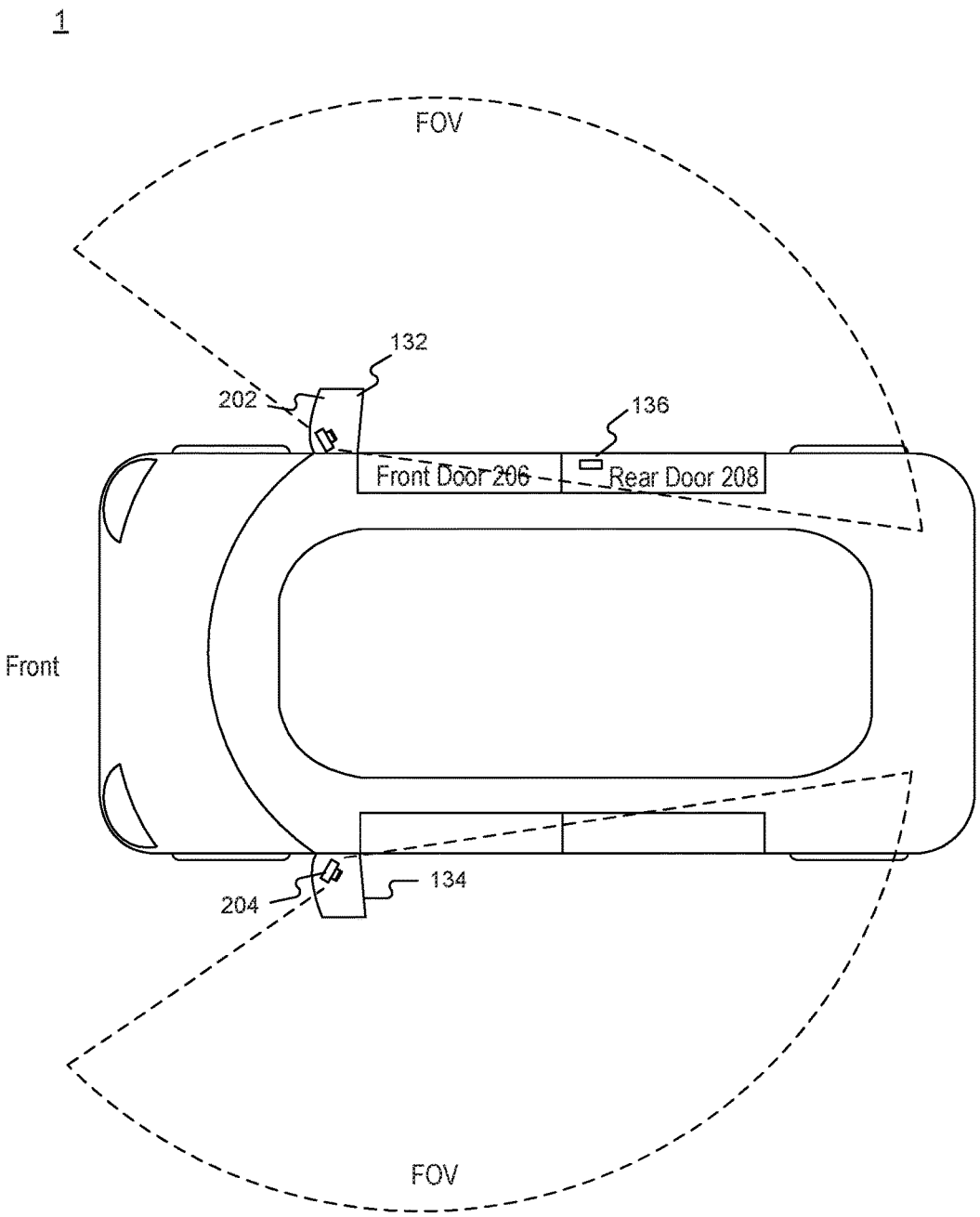
FIG. 2 is a schematic top view of an exemplary embodiment of a vehicle configured to implement the exemplary system of FIG. 1.

FIG. 2 shows a schematic top view of an exemplary vehicle 1 configured to implement system 10 according some embodiments disclosed herein. As illustrated in FIG. 2, vehicle 1 may include two side mirrors 202 and 204, on which image sensors 132 and 134 are located. Although FIG. 2 shows two image sensors 132 and 134 located on the side mirrors 202 and 204, vehicle 1 may have more image sensors located on the exterior of the door or vehicle, the interior side of the door, or inside the vehicle. Vehicle 1 may also include a front door 206 and a rear door 208. A distance sensor 136 may be located on rear door 208. Although FIG. 3 shows one distance sensor 106 located on the rear door, vehicle 1 may have more distance sensor(s) located on the exterior of the door or vehicle, the interior side of the door, or inside the vehicle.

Figure 3:
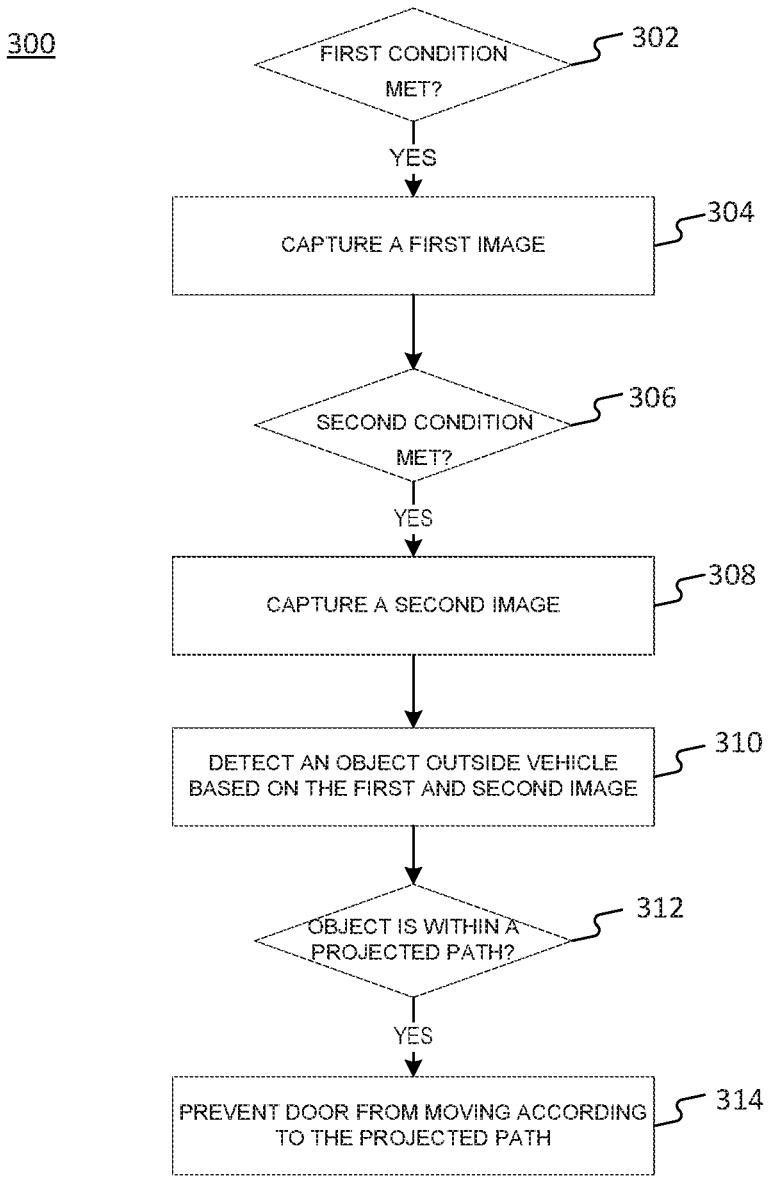
FIG. 3 is a flow chart of an exemplary embodiment of a process that may be performed by the system of FIG. 1.

FIG. 3 is an exemplary flow chart of a process 300 for opening a door of a vehicle. At 302, controller 100 may determine whether a first condition is met. An exemplary first condition may be whether the vehicle is parked. For example, controller 100 may determine that the operator parks the vehicle by placing the transmission in the park position. In another example, operator interface 110 may be configured to detect an action by the operator consistent with parking the vehicle. Operator interface 110 may generate a signal, which may be transmitted to controller 100. Controller 100 may determine that the vehicle is parked based on the received signal. Another exemplary first condition may be whether the door is locked. For example, controller 100 may determine that the door is locked by the operator (via, for example, the key fob) or by controller 100 after the operator leaves the vehicle. If the first condition may be met (the "YES" arrow out of 302 to 304), the process may proceed to 304.

At 304, controller 100 may control a first image sensor to capture a first image of the surroundings in its field of view (FOV). For example, referring to FIG. 3, controller 100 may control image sensor 132 to capture a first image.

At 306, controller 100 may determine whether a second condition is met. An exemplary second condition may be whether the vehicle is deactivated. Deactivating the vehicle following parking the vehicle may indicate that the operator is likely to open the door and exit the vehicle. In some embodiments, controller 100 may determine that the operator deactivates the vehicle by stopping the engine (e.g., if the vehicle is a conventional internal combustion engine vehicle) or shutting down the power of the vehicle (e.g., if the vehicle is an electrical vehicle or hybrid vehicle). In some embodiments, the second condition may be met if the door is unlocked. For example, controller 100 may determine that the door is unlocked by the operator (via, for example, the key fob) or controller 100. Referring again to FIG. 3, if the second condition may be met (the "YES" arrow out of 306 to 308), the process may proceed to 308.

At 308, controller 100 may control the first image sensor to capture a second image. For example, referring to FIG. 2, controller 100 may control image sensor 132 to capture a second image if the vehicle is deactivated. In other embodiments, controller 100 may control image sensor 132 to capture a second image if the door is unlocked by the operator or controller 100.

At 310, controller 100 may receive the first and second images from image sensor 132. Controller 100 may also analyze the first and second images. For example, in some embodiments, controller 100 may compare the first image and the second image. Controller 100 may, for instance, determine differences between the pixel value of each of pixels in the first image and that of each of corresponding pixels in the second image. Controller 100 may further detect one or more objects outside vehicle 1 based on the analysis of the first and second images. Merely by way of example, controller 100 may detect one or more objects based on the determined differences between the pixel value of each of pixels in the first image and that of each of corresponding pixels in the second image. Alternatively or additionally, controller 100 may detect one or more objects from the first and second images using image processing techniques such as edge detection algorithms. Other techniques for recognizing objects, such as pattern recognition, stereoscopic imaging, or image reconstruction, are also contemplated. Controller 100 may also detect the shape and/or size of the detected object(s) based on the first and second images. In some embodiments, controller 100 may further determine the distance between the detected object(s) and a portion of the vehicle based on the first and second images.

Figure 4:
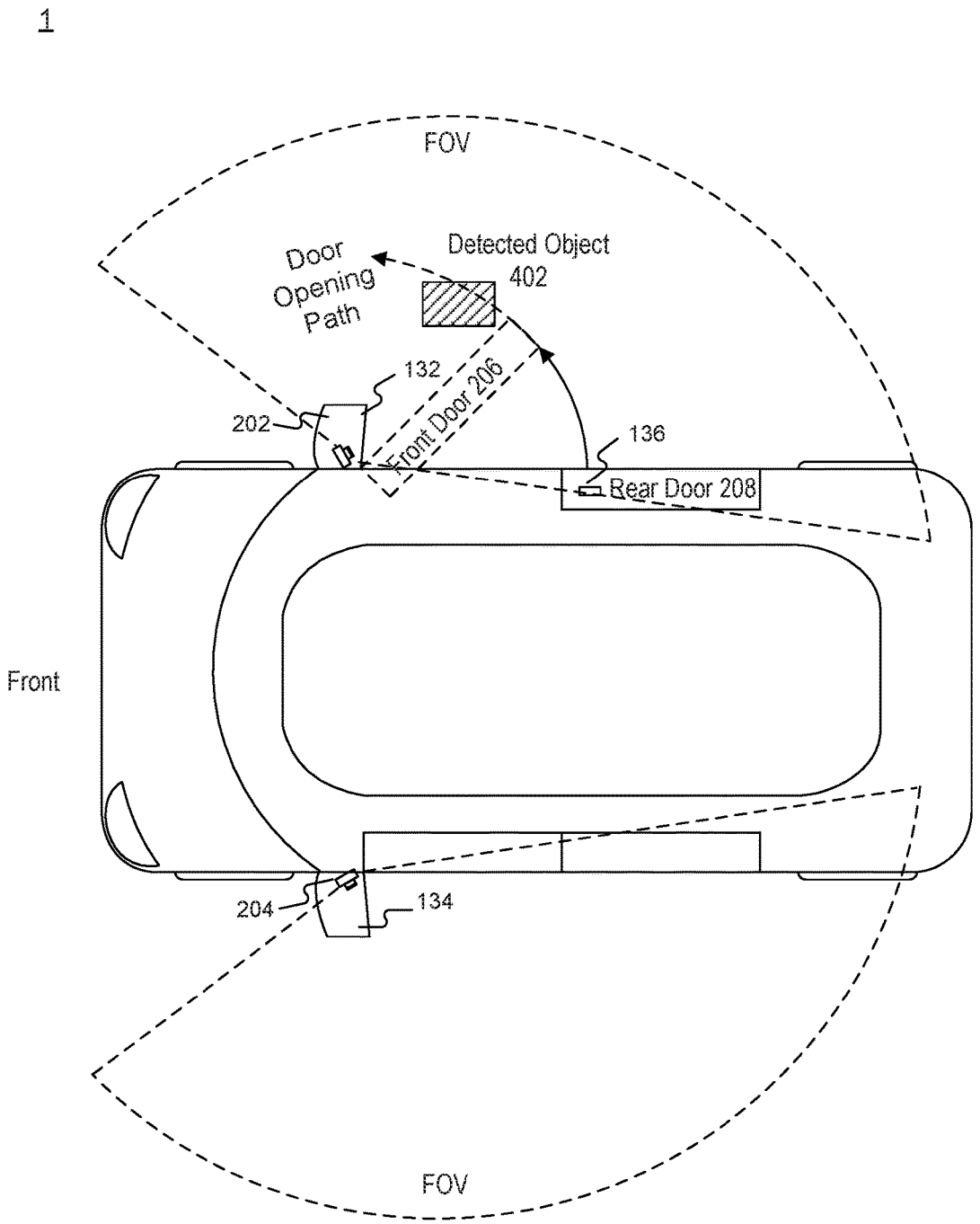
FIG. 4 is a schematic top view of an exemplary embodiment of a vehicle configured to implement the exemplary system of FIG. 1.

FIG. 4 is an illustrative schematic top view of vehicle 1 according to some embodiments disclosed herein. As illustrated in FIG. 4, controller 100 may detect an object 402 based on the first and second images. Controller 100 may also determine the shape and/or size of object 402 based on the first and second images. Controller 100 may further determine a distance between object 402 and a portion of the vehicle (e.g., front door 206).

In some embodiments, controller 100 may also control a distance sensor to determine a distance between the detected object(s) and a portion of the vehicle. For example, referring FIG. 4, controller 100 may control distance sensor 136 to determine a distance between the detected object 402 and a portion of the vehicle (e.g., front door 206).

Alternatively or additionally, in some embodiments, controller 100 may control a second image sensor (e.g., image sensor 134 illustrated in FIG. 2) to capture a third image of the surroundings of the vehicle in its field of view. Controller 100 may reconstruct the surroundings of the vehicle based on the first image, the second image, and the third image. For example, controller 100 may generate a reconstructed image of the surroundings of the vehicle based on the first image, the second image, and/or third image. Merely by way of example, controller 100 may generate a stereoscopic image based on the second and third images. Other techniques (such as computer vision and/or image recognition techniques) for reconstructing the surroundings of the vehicle and detecting one or more objects outside the vehicle are also contemplated.

Referring again to FIG. 3, at 312, controller 100 may determine whether the detected object(s) is/are within a projected path of the door moving from its original position to a first destination position. If it is determined that no object is within the projected path, controller 100 may instruct control interface 120 to control one or more actuators 122 to move the door to the destination position according to the projected path. On the other hand, if it is determined that at least one object is detected to be within the projected path (the "YES" arrow out of 312 to 314), the process may proceed to 314. By way of example, referring to FIG. 4, controller 100 may determine that object 402 is within in a projected path of front door 206 moving from its closed position to a first destination position based on, for example, the shape and/or size of object 402, and/or the distance between object 402 and front door 206.

Referring again to FIG. 3, at 314, controller 100 may control actuator(s) 122 such that the door will not move according to the projected path. Thus, the door may be prevented from contacting the object(s). In other embodiments, controller 100 may generate a control signal for activating protecting mechanism 123 to prevent the door from moving to the first destination position according to the projected path. In some embodiments, protecting mechanism 123 may be configured to provide electromagnetic force resisting movement of the door. In some embodiments, the door is opened slightly but stopped before it reaches the destination position when it is detected that an object is within the projected path. Controller 100 may also actuate alarm 121 to provide a visual or sound alert if it is determined that at least one object is within the projected path.

Alternatively or additionally, in some embodiments, controller 100 may determine a second destination position to which the door may be moved so that the door will not contact the object(s). Controller 100 may also control actuator(s) 122 to move the door to the second destination position. Alternatively or additionally, in some embodiments, controller 100 may determine a maximum angle through which the door may pivot such that the door will contact the detected object(s). Controller 100 may also activate a protecting mechanism to prevent the door from pivot beyond the determined maximum angle.

In some embodiments, referring again to FIG. 3, at 314, if it is determined that at least one object is detected to be within the projected path of the door moving from its original position to the first destination position, controller 100 may first determine whether the detected object is no longer within the projected path after a predetermined period of time (e.g., 5 seconds) of capturing the second image. For example, controller 100 may control image sensor 132 to capture a third image 5 seconds after capturing the second image. Controller 100 may also detect one or more objects outside the vehicle based on the first image, second image, and/or third image using the techniques described elsewhere in this disclosure. Controller 100 may further determine whether any detected object is still within in the projected path using the techniques described elsewhere in this disclosure. If it is determined that no object is within the projected path, the door may move to the first destination position according to the projected path. On the other hand, controller 100 may prevent the door from moving to the first destination position, as described elsewhere in this disclosure.

Figure 5:
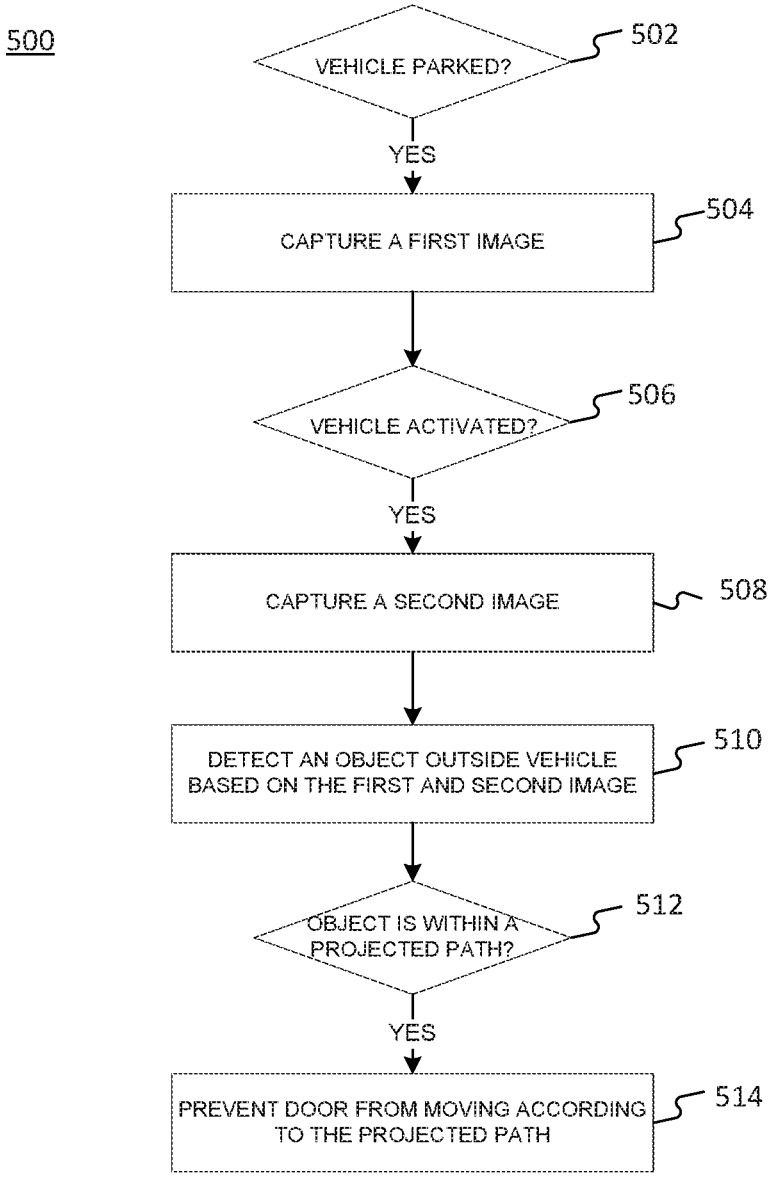
FIG. 5 is a flow chart of an exemplary embodiments of a process that may be performed by the system of FIG. 1.

FIG. 5 is a flow chart of another exemplary process for opening a vehicle door according to some embodiments. At 502, controller 100 may determine whether the vehicle is parked (or whether the vehicle is deactivated), as described elsewhere in this disclosure. If so, referring FIG. 4, side mirror 202 and/or side mirror 204 may be folded by the operator or automatically based on a control signal generated by controller 100. Controller 100, at 504, may also control image sensor 132 (shown in FIG. 2) to capture a first image, as described elsewhere in this disclosure. At 506, controller 100 may determine whether the vehicle is activated (or the door is unlocked). If so, the process may proceed to 508. For example, the operator may come back to the vehicle and activate the vehicle (and/or unlock the door) via, for example, a key fob. Controller 100 may then determine that the vehicle is activated (and/or the door is unlocked), and the process may continue to 508.

At 508, controller 100 may control image sensor 132 to capture a second image, as described elsewhere in this disclosure. In some embodiments, controller 100 may control image sensor 132 to capture the second image before side mirror 202 is unfolded. Controller 100, at 510, may detect one or more objects outside vehicle 1 based on the first and second images, as described elsewhere in this disclosure. For example, controller 100 may determine whether there is any change in the surroundings of the vehicle based on the first and second images. If so, controller 100 may unfold side mirror 202 and control image sensor 132 to capture a third image. Controller 100 may also detect one or more objects outside vehicle 1 based on the first image, the second image, and/or the third image, as described elsewhere in this disclosure. For example, controller 100 may reconstruct the surroundings of vehicle 1 based on the first image, the second image, and/or the third image, as described elsewhere in this disclosure. Merely by way of example, referring to FIG. 4, controller 100 may detect object 402 based on the first image, the second image, and/or the third image. Controller 100 may further determine the shape and/or size of any detected object (e.g., object 402), as described elsewhere in this disclosure. Controller 100 may also determine the distance between object 402 and front door 206 based on the first image, the second image, and/or the third image using the techniques described elsewhere in this disclosure. Controller 100 may further control one or more distance sensors to determine the distance between any detected object and a portion of the vehicle as described elsewhere in this disclosure.

At 512, controller 100 may determine whether the detected object(s) is within the projected path of the door moving from its original position to a first destination position, as described elsewhere in this disclosure. If it is determined that no object is detected within the projected path, the door may be moved according to the projected path, as described elsewhere in this disclosure. If it is determined that at least one object is within the projected path, controller 100, at 514, may prevent the door from moving according to the projected path, as described elsewhere in this disclosure. For example, controller 100 may activate protecting mechanism 123 to prevent the door from moving as described above.

It will be apparent to those skilled in the art that various modifications and variations can be made to the disclosed systems and methods. Other embodiments will be apparent to those skilled in the art from consideration of the specification and practice of the systems and methods. It is intended that the specification and examples be considered as exemplary only, with a true scope being indicated by the following claims and their equivalents.

What is claimed is:

1. A system for opening a door of a vehicle, the system comprising:

a first image sensor configured to capture one or more images;

an actuator configured to move the door from a first position to a second position; and a controller configured to:

control the first image sensor to capture a first image if a first condition is met, wherein the first condition is one of: the controller determines that the vehicle is parked, or the controller determines that the door is locked, control the first image sensor to capture a second image if a second condition is met, wherein the second condition is one of: the controller determines that the vehicle is deactivated, or the controller determines that the door is unlocked, detect an object outside the vehicle based on the first image and the second image, determine whether the detected object is within a projected path of the door moving from the first position to the second position, and control operation of the actuator, such that if the detected object is determined to be within the projected path of the door, the actuator does not move the door according to the projected path, and if no object is detected in the projected path, the actuator moves the door according to the projected path.

2. The system of claim 1, further comprising: a distance sensor configured to determine a distance between the detected object and at least a portion of the vehicle, wherein the controller is further configured to determine whether the detected object is within the projected path of the door based, at least in part, on the determined distance between the detected object and the at least a portion of the vehicle.

3. The system of claim 2, wherein the distance sensor includes at least one of an ultrasonic sensor, a RADAR, or a LIDAR.

4. The system of claim 1, further comprising a second image sensor configured to capture one or more images, wherein the controller is further configured to: control the second image sensor to capture a third image when the first condition may be met; and detect the object outside the vehicle based on the first image, the second image, and the third image.

5. The system of claim 1, wherein the actuator includes a powered actuator.

6. The system of claim 1, further comprising a protecting mechanism, when activated, configured to prevent the door from moving, wherein the controller is further configured to activate the protecting mechanism to prevent the door from moving according to the projected path if an object is determined to be within the projected path.

7. The system of claim 1, wherein the first image sensor is further configured to capture a third image after a predetermined period of time of capturing the second image; and the controller is further configured to determine whether the detected object outside the vehicle is no longer within the projected path based, at least in part, on the third image.

8. The system of claim 1, further comprising an alarm configured to generate an alert when an object is detected to be within the projected path.

9. The system of claim 1, wherein the controller is further configured to:

determine a difference between the first image and the second image; and detect the object outside the vehicle based on the determined difference between the first image and the second image.

10. The system of claim 1, wherein the controller is further configured to:

determine a third position to which the door is moved such that the door will not be in contact with the detected object; and control the actuator to move the door to the third position.

11. A method for opening a door of a vehicle, the method comprising:

capturing, by a first image sensor, a first image when a first condition is met, wherein the first condition is one of: a controller determines that the vehicle is parked, or the controller determines that the door is locked;

capturing, by the first image sensor, a second image when a second condition is met, wherein the second condition is one of: the controller determines that the vehicle is deactivated, or the controller determines that the door is unlocked;

detecting, via the controller, an object outside the vehicle based on the first image and the second image;

determining, by the controller, whether the detected object is within a projected path of the door moving from a first position to a second position; and controlling, by the controller, operation of an actuator configured to move the door, such that if the detected object is determined to be within the projected path of the door, the actuator does not move the door according to the projected path, and if no object is detected in the projected path, the actuator moves the door according to the projected path.

12. The method of claim 11, further comprising:

determining, by a distance sensor, a distance between the detected object and at least a portion of the vehicle; and determining, by the controller, whether the detected object is within the projected path of the door based, at least in part, on the determined distance between the detected object and the at least a portion of the vehicle.

13. The method of claim 12, wherein the distance sensor includes at least one of an ultrasonic sensor, a RADAR, or a LIDAR.

14. The method of claim 11, further comprising:

capturing, by a second image sensor, a third image when the first condition may be met; and detecting, by the controller, the object outside the vehicle based on the first image, the second image, and the third image.

15. The method of claim 11, wherein the actuator includes a powered actuator.

16. The method of claim 11, further comprising activating, by the controller, a protecting mechanism to prevent the door from moving according to the projected path if an object is determined to be within the projected path.

17. The method of claim 11, further comprising:

capturing, by the first image sensor, a third image after a predetermined period of time of capturing the second image; and determining, by the controller, whether the detected object outside the vehicle is no longer within the projected path based, at least in part, on the third image.

18. The method of claim 11, further comprising generating, by an alarm, an alert when an object is detected to be within the projected path.

19. The method of claim 11, further comprising:

determining, by the controller, a difference between the first image and the second image; and detecting, by the controller, the object outside the vehicle based on the determined difference between the first image and the second image.

20. A non-transitory computer-readable medium storing instructions that, when executed, cause one or more processors to perform a method for opening and closing a vehicle door, the method comprising:

receiving a first image captured by a first image sensor when a first condition is met, wherein the first condition is one of that: the vehicle is parked, or the door is locked;

receiving a second image captured by the first image sensor when a second condition is met, wherein the second condition is one of that: the vehicle is deactivated, or the door is unlocked;

detecting an object outside the vehicle based on the first image and the second image;

determining whether the detected object is within a projected path of the door moving from a first position to a second position; and controlling operation of an actuator configured to move the door, such that if the detected object is determined to be within the projected path of the door, the actuator does not move the door according to the projected path, and if no object is detected in the projected path, the actuator moves the door according to the projected path.

* * * * *